US006848891B2

(12) United States Patent
Dieterich

(10) Patent No.: US 6,848,891 B2
(45) **Date of Patent: *Feb. 1, 2005**

(54) SCREW COMPRESSOR HAVING BEARINGS FOR THE DRIVE SHAFT OF THE COMPRESSOR SCREW AND THE MOTOR

(75) Inventor: Rolf Dieterich, Horb (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/696,800

(22) Filed: Oct. 30, 2003

(65) Prior Publication Data

US 2004/0086410 A1 May 6, 2004

Related U.S. Application Data

(63) Continuation of application No. 10/234,649, filed on Sep. 3, 2002, now Pat. No. 6,666,661, which is a continuation of application No. PCT/EP01/15247, filed on Dec. 21, 2001.

(30) Foreign Application Priority Data

Jan. 5, 2001 (DE) ..... 101 01 016

(51) Int. Cl.[7] ..... F04B 17/03; F04C 18/16; F04C 29/02

(52) U.S. Cl. ..... 417/410.4; 418/94; 418/201.1

(58) Field of Search ..... 417/410.3, 410.4; 418/94, 201.1; 415/72, 73, 216.1, 229

(56) References Cited

U.S. PATENT DOCUMENTS

| | | | | |
|---|---|---|---|---|
| 4,957,417 | A | 9/1990 | Tsuboi | 418/201.1 |
| 6,364,645 | B1 | 4/2002 | Dieterich | 418/201.1 |
| 2001/0036417 | A1 | 11/2001 | Hioki et al. | 418/201.1 |

FOREIGN PATENT DOCUMENTS

| | | | |
|---|---|---|---|
| EP | 1 174 621 | 1/2002 | |
| JP | 54-115409 | 9/1979 | 418/201.1 |
| JP | 54-154811 | 12/1979 | 418/94 |
| JP | 4-159480 | 6/1992 | 418/94 |
| WO | 01/61194 | 8/2001 | |

OTHER PUBLICATIONS

*Patent Abstracts of Japan*, Abstract of Japanese Patent "Screw Compressor", Publication No. 06330874, Nov. 29, 1994, Japanese Application No. 05123764, Filed May 26, 1993.

*Patent Abstracts of Japan*, Abstract of Japanese Patent "Sealed Electric Compressor and Cooling Device", Publication No. 07317684, Dec. 5, 1995, Japanese Application No. 06111488, Filed May 25, 1994.

*Patent Abstracts of Japan*, Abstract of Japanese Patent "Sealed Type Screw Compressor", Publication No. 54115409, Sep. 8, 1979, Japanese Application No. 53022086, Filed Mar. 1, 1978.

*Patent Abstracts of Japan*, Abstract of Japanese Patent "Screw Compressor", Publication No. 54154811, Dec. 6, 1979, Japanese Application No. 53062328, Filed May 26, 1978.

*Primary Examiner*—John J. Vrablik
(74) *Attorney, Agent, or Firm*—Barry R. Lipsitz

(57) ABSTRACT

The present invention provides an improved refrigerant compressor comprising an overall casing, an electric motor with a stator and a rotor which is mounted on a drive shaft, and a screw compressor. A compressor screw of the screw compressor is mounted on the drive shaft, which is rotatably mounted in the casing by a first radial bearing between the rotor and the compressor screw and a second radial bearing disposed on a side of the compressor screw lying opposite the first radial bearing. The drive shaft is mounted in the casing by a third radial bearing disposed on a side of the rotor lying opposite the first radial bearing. A portion of the drive shaft which extends between the first radial bearing and one of the second and third radial bearings being adapted to compensate for alignment errors between the three radial bearings.

18 Claims, 2 Drawing Sheets

SCREW COMPRESSOR HAVING BEARINGS FOR THE DRIVE SHAFT OF THE COMPRESSOR SCREW AND THE MOTOR

This application is a continuation of commonly assigned U.S. patent application No. 10/234,649 filed on Sep. 3, 2002, U.S. Pat. No. 6,666,661 which is a continuation of international application No. PCT/EP01/15247 filed on Dec. 21, 2001, and which claims the benefit of German patent application no. 101 01 016 filed on Jan. 5, 2001.

BACKGROUND OF THE INVENTION

The invention relates to a refrigerant compressor, comprising an overall casing, an electric motor disposed in the overall casing with a stator and a rotor which is mounted on a drive shaft, and also a screw compressor disposed in the overall casing, one compressor screw of which is mounted on the drive shaft, which is rotatably mounted in the overall casing by a first radial bearing between the rotor and the compressor screw and a second radial bearing disposed on a side of the compressor screw lying opposite the first radial bearing.

In the case of a refrigerant compressor formed in this way, the rotor is usually mounted on a freely projecting portion of the drive shaft extending from the first radial bearing on the side lying opposite the compressor screw, which has the effect that great efforts are required to ensure that this freely projecting portion of the drive shaft is not subjected to excessive moments, which lead to a gap between the rotor and the stator being reduced to zero, and consequently the rotor touching the stator, in particular when asymmetrical forces occur on the rotor.

It is therefore an object of the invention to improve a refrigerant compressor of the generic type in such a way that the risk of the stator being touched by the rotor no longer occurs.

SUMMARY OF THE INVENTION

This object is achieved according to the invention in the case of a refrigerant compressor of the type described at the beginning by the drive shaft being mounted in the overall casing by a third radial bearing, which is disposed on a side of the rotor lying opposite the first radial bearing, and by a drive portion of the drive shaft which extends between the first radial bearing and the third radial bearing being formed in such a way as to compensate for alignment errors between the three radial bearings.

The advantage of the solution according to the invention can be seen in that in fact the provision of a third radial bearing for the drive shaft should result in excessive fixing in the mounting of the drive shaft, since the drive shaft is well-defined with regard to its alignment in relation to the overall casing on the basis of two radial bearings, that is to say the radial bearings disposed on both sides of the compressor screw, with the result that, if it is assumed that the third radial bearing cannot be disposed in relation to the two other radial bearings without alignment errors, the radial bearings are always subjected to constraining forces caused by the alignment error.

This problem of the excessively determined mounting of the drive shaft is now also solved according to the invention by the drive portion between the first radial bearing and the third radial bearing being formed as the portion compensating for alignment errors, that is to say it is to this extent movable transversely in relation to an axis in the region of the third radial bearing with respect to the first radial bearing, so that lowest possible undesired constraining forces act on the third radial bearing. At the same time, however, the third radial bearing allows a defined support of the drive shaft in such a way that touching of the rotor and stator of the electric motor can be avoided in spite of bending moments occurring, for example during starting of the electric motor.

This would be achievable for example by the drive portion being able to move transversely in relation to its axis in some subregion, it being possible for this movement to be accomplished for example by a jointed portion within the drive portion.

Since, however, on account of the large torques to be transmitted, a mechanical joint can only be accomplished with great expenditure, it is preferably provided that at least part of the drive portion is flexibly formed.

Such a flexible form is possible, for example, over the entire drive portion. However, it is particularly advantageous if an intermediate portion lying between the first radial bearing and the rotor is flexibly formed, since this intermediate portion, connected substantially directly to the first radial bearing, can be formed in a simple way such that it has the necessary flexibility to compensate for the alignment errors of the third radial bearing.

In spite of the flexible behavior, it is however important within the scope of the invention that the outside diameter of the drive portion is chosen such that the maximum torque applied by the electric motor can be transmitted to the screw compressor, and consequently the rotary drive of the screw compressor is ensured.

A basis for dimensioning the outside diameter of the drive portion such that it still has the required flexibility is provided by the requirement that an outside diameter of at least part of the drive portion is less than one fifth of the rotor length, even better less than one sixth of the rotor length.

The solution according to the invention makes it possible in particular to use long rotors, and consequently inexpensive electric motors, the rotor length in the case of long rotors of this type preferably being equal to or greater than 1.7 times the outside diameter of the rotor, even better equal to or greater than twice the outside diameter of the rotor.

This allows use in particular of electric motors which, in spite of their power, are inexpensive.

With regard to the way in which the third radial bearing is disposed, nothing specific has been stated in connection with the explanation so far of the individual exemplary embodiments. It would be conceivable, for example, for a separate bearing mount to be provided for the third radial bearing.

However, it is particularly advantageous if the third radial bearing is held by a cover of the overall casing. It is consequently very easily possible to provide a bearing mount for the third radial bearing and integrate it into the overall casing in such a way that the overall casing can be of a simple structural design.

With regard to the form of the radial bearings, nothing specific has been stated in connection with the explanation so far of the solution according to the invention. It would be conceivable, for example, for the bearings to be formed as rolling or sliding bearings.

Since, however, the first and second radial bearings are preferably formed as rolling bearings on account of the precise guidance of the compressor screw, the third radial bearing is also preferably formed as a rolling bearing.

With regard to the lubrication of the radial bearing, nothing specific has been stated in connection with the explanation so far of the individual exemplary embodiments. It is preferably envisaged that the drive shaft is provided with a lubricant channel leading to the third radial bearing.

The lubricant channel is suitably formed in such a way that it also leads to the first and second radial bearings.

With regard to the construction of the overall casing, a wide variety of possibilities are conceivable. For example, it would be conceivable to divide the overall casing in such a way that the screw compressor and the electric motor are disposed in separate portions of the casing.

A particularly advantageous solution provides, however, that the overall casing has a central portion in which the compressor screw and the stator are disposed with the rotor of the electric motor and which is closed off on the side having the electric motor by a casing cover and is closed off on the side opposite the casing cover by a casing end portion which can be fitted on.

Such a solution has the great advantage that mounting of the entire refrigerant compressor can take place in a simple and suitable way.

It is particularly advantageous in this respect if a compressor casing of the screw compressor is disposed in the central portion, so that the compressor casing itself can be positioned with great precision in relation to the central portion.

A solution of this type is particularly advantageous if the compressor casing is integrally formed into the central portion.

With regard to the way in which the bearing mounts are disposed, it is likewise the case that nothing specific has been stated so far. An advantageous solution provides that a bearing mount of the first radial bearing is disposed in the central portion.

This bearing mount is also preferably integrally formed into the central portion.

With regard to the provision of a second bearing mount for the second radial bearing, it is likewise the case that nothing specific has been stated so far. It is advantageous if the second bearing mount is disposed in the casing end portion, since disposing the second bearing mount in this way makes simple assembly possible.

Finally, with regard to a mount for the stator of the electric motor, it is likewise the case that nothing specific has been stated. It is particularly advantageous if a mount for the stator of the electric motor is provided in the central portion, the mount for the stator likewise being integrally formed in the central portion.

Further features and advantages of the solution according to the invention are the subject of the following description and the graphic representation of an exemplary embodiment.

DETAILED DESCRIPTION OF THE INVENTION

Figure 1:
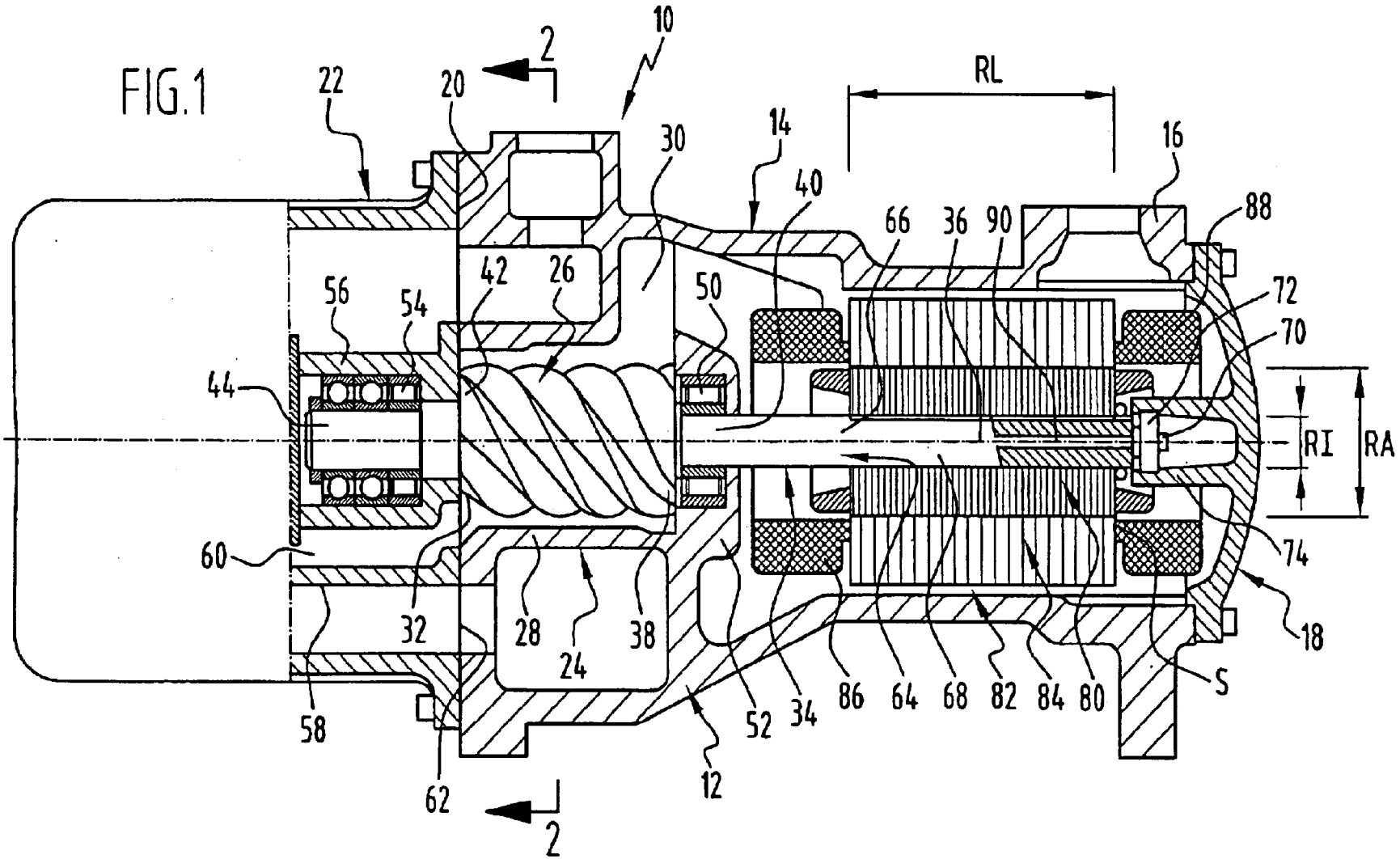
FIG. 1 shows a longitudinal section through an exemplary embodiment of a refrigerant compressor according to the invention.
Figure 2:
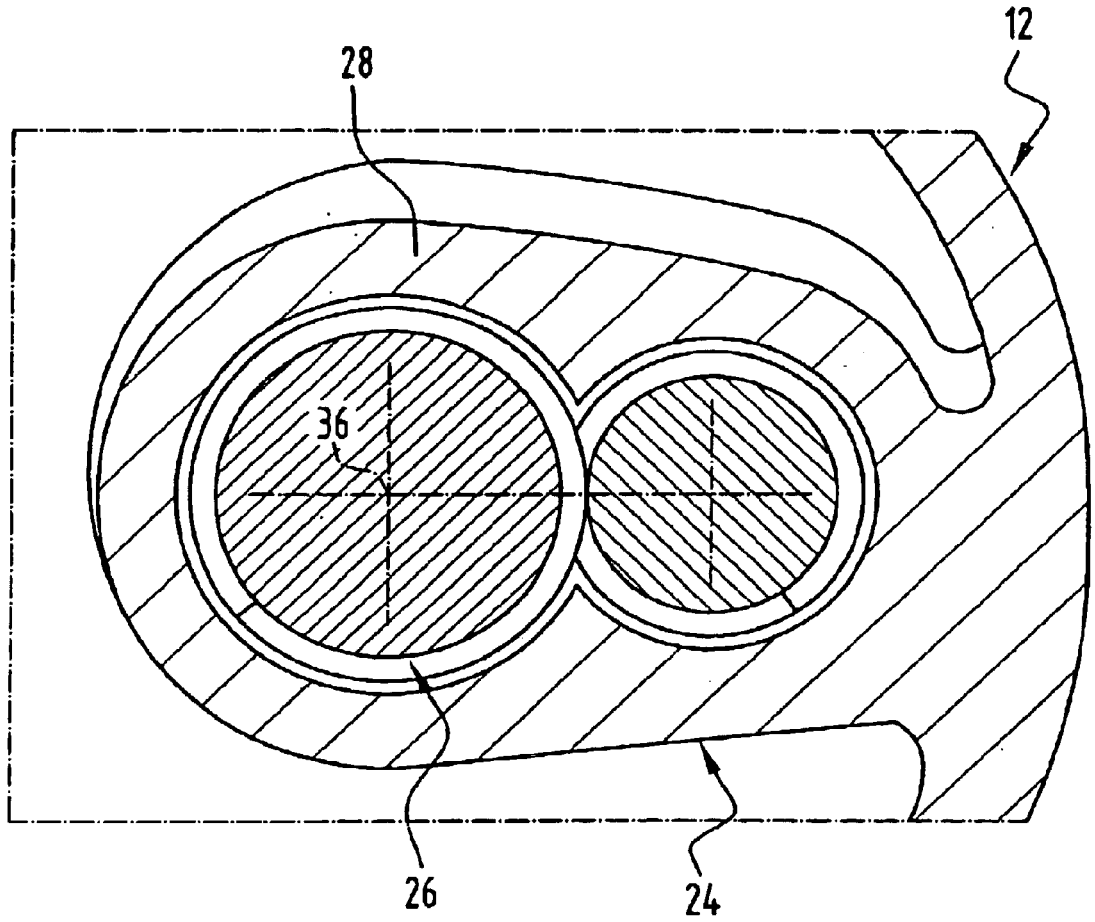
FIG. 2 shows the section cut 2—2 of FIG. 1 of an exemplary embodiment of a refrigerant compressor according to the invention.

An exemplary embodiment of a refrigerant compressor according to the invention, represented in FIGS. 1 and 2 and designated as a whole by 10, comprises an overall casing 12, which is formed by a central portion 14, a casing cover 18 disposed on one side 16 of the central portion 14 and a casing end portion 22 disposed on an opposite side 20 of the central portion 14.

Disposed in the central portion 14 of the overall casing 12 is a screw compressor, which is designated as a whole by 24 and usually comprises two compressor screws, as shown is FIG. 2 one of which, compressor screw 26, can be seen in FIG. 1, this screw for its part being disposed in a rotating manner in a compressor casing 28 and the compressor casing 28 being integrally formed into the central portion 14 and extending from an inlet 30 to an outlet 32.

The compressor screw 26 is for its part mounted on a drive shaft which is designated as a whole by 34 and extends with its longitudinal axis 36 coaxially in relation to the compressor screw 26 and beyond the latter on both sides, to be precise beyond an inlet-side end 38 of the compressor screw 26 with a first bearing portion 40 and beyond an outlet-side end 42 of the compressor screw 26 with a second bearing portion 44.

The first bearing portion 40 of the drive shaft 34 is in this case rotatably mounted in the central portion 14 by a first radial bearing 50, the first radial bearing 50 being mounted in a first bearing mount 52, which for its part is integrally formed into the central portion 40 and forms an inlet-side termination of the compressor casing 28.

The second bearing portion 44 is rotatably mounted by a second radial bearing 54, the second radial bearing 54 being disposed in a second bearing mount 56, which for its part is provided in the casing end portion 22 and is part of an outlet-side terminating element 58 of the compressor casing 28, which also has an outlet channel 60.

The outlet-side terminating element 58 is in this case securely connected to the central portion 14 and the compressor casing 28 by means of the fixing of the casing end portion 22, the central portion 14 and the casing end portion 22 being separable by a common separating plane 62, which at the same time also represents a separating plane 62 between the compressor casing 28 in the central portion 14 and the outlet-side terminating element 58 in the casing end portion 22.

Furthermore, the drive shaft 34 also extends beyond the first bearing portion 40 on a side lying opposite the compressor screw 26 and forms a drive portion 64, which for its part has an intermediate portion 66, connecting directly with the first bearing portion 40, and, following the intermediate portion 66, has a rotor portion 68 and finally, following the rotor portion 68, has a third bearing portion 70, which is mounted by a third radial bearing 72 in a third bearing mount 74, which for its part is integrally formed onto the casing cover 18 and fixed to the central portion 14 via the casing cover 18.

Mounted overall in this case on the rotor portion 68 is a rotor, designated as a whole by 80, of an electric motor 82, which is enclosed by a stator 84, which for its part is securely disposed in the central portion 14 and carries windings 86 and 88 on both sides—seen in the direction of the axis 36.

The rotor 80 has in this case, in a direction parallel to the axis 36 of the drive shaft 34, a rotor length RL and, radially in relation to the axis 36, an inside rotor diameter RI, which corresponds to the outside diameter of the rotor portion 68.

The rotor preferably has a rotor length RL which is at least 1.7 times, preferably more than twice, the outside rotor diameter RA.

Furthermore, the inside rotor diameter RI is less than one fifth, even better less than one sixth, of the rotor length RL.

For reasons of simplest possible assembly, the drive shaft 34 is formed in such a way that the third bearing portion 70 has an outside diameter which is less than an outside diameter of the rotor portion 68 and the outside diameter of the rotor portion 68 is less than an outside diameter of the intermediate portion 66, and this in turn corresponds approximately in its outside diameter to that of the first bearing portion 40.

With an overhung mounting of the rotor 80, it is necessary for reasons of strength for the diameter of the bearing portion 34, and consequently also the diameter of the bearing portion 40, to be much greater than they are made in the case of the present solution. In the case of the present solution, the inside diameter of the first radial bearing 50 can be made comparatively smaller, which makes it possible to use a radial bearing of a greater load-bearing capacity (and consequently greater service life) or a shorter and less expensive bearing with a comparable load-bearing capacity.

However, the outside diameter of the rotor portion 68 and the outside diameter of the intermediate portion 66 are approximately of the same size, so that the outside diameter of the intermediate portion 66 is preferably likewise less than one fifth, even better less than one sixth, of the rotor length RL.

On account of the necessity for precision mounting of the compressor screw 26 in the compressor casing 28, the alignment of the drive shaft 34 is predetermined by the first radial bearing 50 and the second radial bearing 54, which are preferably formed as rolling bearings, the second radial bearing 54 additionally also being formed as an axial bearing. Consequently, the entire drive shaft 34 is aligned in a defined manner in its alignment in relation to the overall casing 12, and consequently also in relation to the central portion 14 of the same, by the first radial bearing 50 and the second radial bearing 54.

However, the fact that the rotor 80 of the electric motor 82 is of an appreciable weight, and may also be subjected to forces which are asymmetrical with respect to the axis 36 when the electric motor 82 is running, in particular in the stator 84 when the motor is starting, has the effect that a considerable bending moment acts on the drive portion 64, in particular the rotor portion 68, with the result that a gap S between the rotor 80 and the stator 84 cannot be maintained in the presence of large forces, and consequently the rotor 80 and the stator 84 could touch. To prevent this, the third radial bearing 72 is provided, which however is excessive for the geometrical alignment of the drive shaft 34 provided by the radial bearings 50 and 54, in particular since a third radial bearing 72 of this type is always disposed with alignment errors in relation to the other radial bearings 50 and 54, even if these alignment errors are small.

For this reason, the drive portion 64, in particular the intermediate portion 66 of the same, is formed in such a way that it is flexible transversely in relation to the axis 36, whereby the excessive effect on the alignment of the drive shaft 34 caused by a total of three radial bearings 50, 54 and 72 can be avoided.

In this case, the intermediate portion 66 is preferably dimensioned in such a way that it is still capable of transmitting the entire torque applied by the rotor 80, but is yielding with regard to bending moments directed transversely in relation to the axis 36, that this flexible compliance of the intermediate portion 66 is adequate to compensate for the alignment errors of the third radial bearing 72 in relation to the first and second radial bearings 50, 54 occurring due to a movement transversely in relation to the axis 34, and to avoid large constraining forces.

The flexibility of the intermediate portion 66 can be fixed most easily by a diameter of the same which is preferably less than one fifth, even better less than one sixth, of the rotor length RL, the possibility existing in the case of the solution according to the invention of using rotors 80 with a large rotor length RL, since the bending moments occurring as a result of this rotor length RL and the bending moments during starting of the electric motor are intercepted by the third radial bearing 72, additionally supporting the drive shaft 34, and consequently the gap S between the rotor 80 and the stator 84 can be kept small without the risk of the rotor 80 and the stator 84 touching.

In particular, the present invention makes it possible to use rotors 80 with a rotor length RL which is greater than 1.7 times the outside rotor diameter RA, even better greater than 2 times, even better greater than 2.1 times, the outside rotor diameter RA.

To ensure advantageous lubrication of the radial bearings 50, 54 and 72, the drive shaft 34 is preferably provided with a continuous lubricant channel 90, which is formed in such a way that it supplies the respective radial bearings 50, 54 and 72 with lubricant via the corresponding bearing portions 40, 44 and 70.

What is claimed is:

1. A refrigerant compressor, comprising:

an overall casing, an electric motor disposed in the overall casing with a stator and a rotor, a screw compressor disposed in the overall casing, a compressor screw of which is rotatably mounted in the overall casing, and a drive shaft, said drive shaft being a one-piece part extending in an axial direction beyond both sides of the rotor and said compressor screw and bearing the rotor and said compressor screw, said drive shaft being rotatably mounted in said overall casing by a first radial roller bearing between the rotor and the compressor screw and a second radial roller bearing disposed on a side of the compressor screw lying opposite the first radial roller bearing, and said drive shaft being mounted in the overall casing by a third radial roller bearing which is disposed on a side of the rotor lying opposite the first radial roller bearing, the drive shaft which extends between the third radial roller bearing and the second radial roller bearing being adapted to compensate for alignment errors between the three radial roller bearings.

2. The refrigerant compressor as claimed in claim 1, wherein at least part of the drive portion is adapted to be flexible with respect to bending.

3. The refrigerant compressor as claimed in claim 1, wherein an outside diameter of the drive portion is adapted such that the maximum torque applied by the rotor can be transmitted to the screw compressor.

4. The refrigerant compressor as claimed in claim 1, wherein an outside diameter of at least part of the drive portion is less than one fifth of the rotor length.

5. The refrigerant compressor as claimed in claim 4, wherein the outside diameter of at least part of the drive portion is equal to or less than one sixth of the rotor length.

6. The refrigerant compressor as claimed in claim 4, wherein the rotor length is equal to or greater than 1.7 times the outside rotor diameter.

7. The refrigerant compressor as claimed in claim 6, wherein the rotor length is equal to or greater than twice the outside rotor diameter.

8. The refrigerant compressor as claimed in claim 1, wherein the third radial bearing is held by a cover of the overall casing.

9. The refrigerant compressor as claimed in claim 1, wherein said screw compressor comprises more than one compressor screw.

10. The refrigerant compressor as claimed in claim 1, wherein the drive shaft is provided with a lubricant channel leading to the third radial bearing.

11. The refrigerant compressor as claimed in claim 1, wherein the overall casing has a central portion which is closed off on the side having the electric motor by a casing cover and is closed off on the side opposite the casing cover by a casing end portion which can be fitted on.

12. The refrigerant compressor as claimed in claim 11, wherein a compressor casing of the screw compressor is disposed in the central portion.

13. The refrigerant compressor as claimed in claim 12, wherein the compressor casing is integrally formed into the central portion.

14. The refrigerant compressor as claimed in claim 11, wherein a first bearing mount of the first radial bearing is disposed in the central portion.

15. The refrigerant compressor as claimed in claim 14, wherein the bearing mount is integrally formed into the central portion.

16. The refrigerant compressor as claimed in claim 11, wherein a second bearing mount of the second radial bearing is disposed in the casing end portion.

17. The refrigerant compressor as claimed in claim 11, wherein a mount for the stator of the electric motor is provided in the central portion.

18. The refrigerant compressor as claimed in claim 17, wherein the mount for the stator is integrally formed in the central portion.

* * * * *